US009933800B1

(12) United States Patent
Tadinada et al.

(10) Patent No.: US 9,933,800 B1
(45) Date of Patent: Apr. 3, 2018

(54) FREQUENCY COMPENSATION FOR LINEAR REGULATORS

(71) Applicant: SYNAPTICS INCORPORATED, San Jose, CA (US)

(72) Inventors: Aswani Tadinada, Hyderabad (IN); Sivan Kumar Pandian, Hyderabad (IN); Kaushalendra Tripathi, Pleasanton, CA (US); Srinivasaraju Dhenuvakonda, Hyderabad (IN)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 15/283,219

(22) Filed: Sep. 30, 2016

(51) Int. Cl.
*G05F 1/575* (2006.01)

(52) U.S. Cl.
CPC ..... *G05F 1/575* (2013.01)

(58) Field of Classification Search
CPC ... G05F 1/575; G06F 1/10; G06F 1/46; G06F 1/461; G06F 1/56; G06F 1/59
USPC ..... 327/543
See application file for complete search history.

(56) References Cited

U.S. PATENT DOCUMENTS 5,559,424 A 9/1996 Wrathall et al.
5,689,460 A * 11/1997 Ooishi ..... G11O 5/143 327/530
5,889,393 A 3/1999 Wrathall
6,522,111 B2 2/2003 Zadeh et al.
6,690,147 B2 2/2004 Bonto
6,710,583 B2 3/2004 Stanescu et al.
6,765,374 B1 7/2004 Yang et al.
6,794,914 B2 9/2004 Sani et al.
6,806,690 B2 10/2004 Xi
6,933,708 B2 8/2005 Hamon et al.
7,215,103 B1 5/2007 Wong et al.
7,570,035 B2 8/2009 Kleveland
7,843,180 B1 11/2010 Cilingiroglu
8,080,983 B2 12/2011 Laurens et al.
8,089,261 B2 1/2012 Lipka
8,242,761 B2 8/2012 Napravnik
8,265,574 B2 * 9/2012 Karnik ..... G05F 1/575 323/280
8,289,009 B1 10/2012 Strik et al.
8,970,188 B2 3/2015 Ganta
9,122,293 B2 9/2015 Price et al.
9,170,590 B2 10/2015 Price et al.
9,235,225 B2 1/2016 Price et al.
9,459,642 B2 * 10/2016 Chen ..... G05F 1/575
9,577,508 B2 * 2/2017 Wang ..... H02M 1/15
(Continued)

*Primary Examiner* — Ryan Jager
(74) *Attorney, Agent, or Firm* — Patterson + Sheridan, LLP

(57) ABSTRACT

A linear voltage regulator and associated integrated circuit and method are disclosed. The linear voltage regulator is operable within a plurality of predefined operational modes, and comprises a pass element configured to generate an output voltage based on a received input voltage. The linear voltage regulator further comprises an error amplifier comprising an output node coupled with a control node of the pass element. The error amplifier is configured to generate a control signal at the output node based on the output voltage and a reference voltage. The linear voltage regulator further comprises a frequency compensation circuit configured to selectively apply an impedance to the output node based on which of the predefined operational modes is selected.

20 Claims, 5 Drawing Sheets

(56) References Cited

U.S. PATENT DOCUMENTS

| | | | | |
|---|---|---|---|---|
| 2002/0130646 | A1 | 9/2002 | Zadeh et al. | |
| 2004/0046532 | A1 | 3/2004 | Menegoli et al. | |
| 2004/0104711 | A1 | 6/2004 | Scoones et al. | |
| 2005/0189930 | A1 | 9/2005 | Wu et al. | |
| 2006/0170401 | A1* | 8/2006 | Chen | G05F 1/575 323/273 |
| 2008/0016979 | A1 | 1/2008 | Yasumura et al. | |
| 2008/0169795 | A1* | 7/2008 | Wang | G05F 1/575 323/280 |
| 2010/0253431 | A1* | 10/2010 | Fujiwara | H03F 1/086 330/253 |
| 2012/0038332 | A1* | 2/2012 | Lin | G05F 1/575 323/277 |
| 2013/0147271 | A1 | 6/2013 | Yotsuji et al. | |
| 2014/0117956 | A1 | 5/2014 | Price et al. | |
| 2014/0117958 | A1* | 5/2014 | Price | G05F 1/468 323/281 |
| 2016/0147239 | A1* | 5/2016 | Yan | G05F 1/575 323/280 |
| 2017/0033557 | A1* | 2/2017 | Chu | H02H 9/045 |

* cited by examiner

FREQUENCY COMPENSATION FOR LINEAR REGULATORS

BACKGROUND

Field

Embodiments of the present disclosure generally relate to techniques for frequency compensation of linear regulators to thereby improve stability during operation.

Description of the Related Art

Linear regulators receive an input voltage and produce a stable output voltage across a load element, even where the input voltage includes ripple or other small voltage variations. Generally, an effective resistance of the linear regulator changes responsive to changes in a resistance of the load element (or changes in a current flowing through the load element) in order to maintain the stable output voltage. Linear regulators require an input voltage at least some minimum amount (called a "dropout voltage") higher than the desired output voltage. When the dropout voltage is less than about 2 or 3 volts, which is common for producing supply voltages within low-voltage microprocessors or other integrated circuits (ICs), "low-dropout" regulators (LDO) are used.

Stable operation of linear regulators is generally desirable across a range of input voltages, across a range of temperatures, and across a range of load currents. Linear regulators employ a feedback loop in order to hold the stable output voltage. The feedback signal experiences changes in both gain and phase as it travels through the feedback loop, and the amount of phase shift which has occurred at the unity gain (0 dB) frequency generally determines stability of the linear regulator.

SUMMARY

One embodiment described herein is a linear voltage regulator operable within a plurality of predefined operational modes. The linear voltage regulator comprises a pass element configured to generate an output voltage based on a received input voltage, and an error amplifier comprising an output node coupled with a control node of the pass element. The error amplifier is configured to generate a control signal at the output node based on the output voltage and a reference voltage. The linear voltage regulator further comprises a frequency compensation circuit configured to selectively apply an impedance to the output node based on which of the predefined operational modes is selected.

Another embodiment described herein is an integrated circuit (IC) comprising a load element and a linear voltage regulator circuit configured to provide a load current to the load element. The linear voltage regulator circuit is operable within a plurality of predefined operational modes and comprises a pass element configured to generate an output voltage across the load element based on a received input voltage. The linear voltage regulator circuit further comprises an error amplifier comprising an output node coupled with a control node of the pass element, the error amplifier configured to generate a control signal at the output node based on the output voltage and a reference voltage. The linear voltage regulator circuit further comprises a frequency compensation circuit configured to selectively apply an impedance to the output node based on which of the predefined operational modes is selected.

Another embodiment described herein is a method of operating a linear voltage regulator comprising a pass element and an error amplifier, the linear voltage regulator operable within a plurality of predefined operational modes. The method comprises generating, using the pass element, an output voltage based on a received input voltage. The method further comprises generating, at an output node of the error amplifier, a control signal based on the output voltage and a reference voltage, the output node coupled with a control node of the pass element. The method further comprises selectively applying, using a frequency compensation circuit, an impedance to the output node based on which of the predefined operational modes is selected.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

Figure 1:
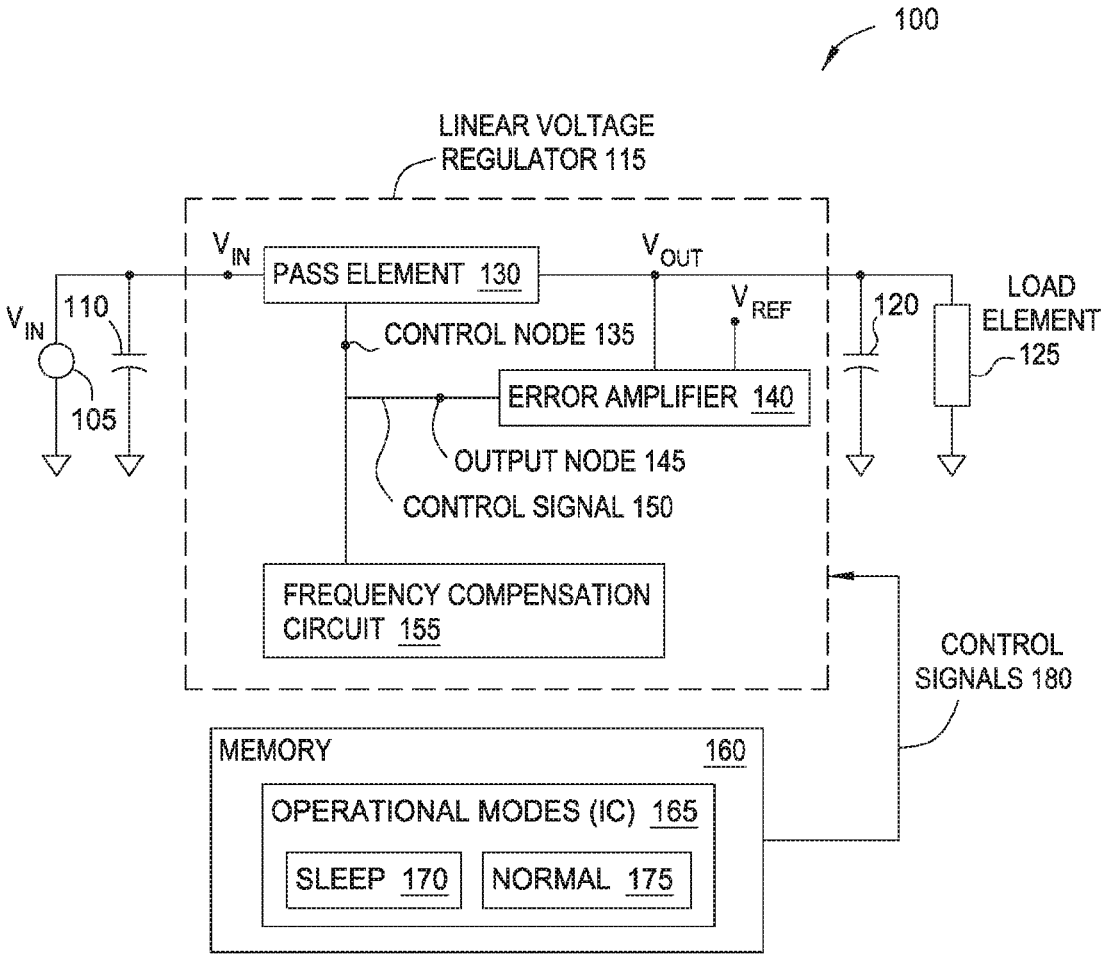
FIG. 1 is a schematic block diagram of an integrated circuit having a linear voltage regulator, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or in the following detailed description.

Embodiments described herein generally include a linear voltage regulator and associated integrated circuit and method. The linear voltage regulator is operable within a plurality of predefined operational modes, and comprises a pass element configured to generate an output voltage based on a received input voltage. The linear voltage regulator further comprises an error amplifier comprising an output node coupled with a control node of the pass element. The error amplifier is configured to generate a control signal at the output node based on the output voltage and a reference voltage. The linear voltage regulator further comprises a frequency compensation circuit configured to selectively apply an impedance to the output node based on which of the predefined operational modes is selected.

The plurality of predefined operational modes for the linear voltage regulator generally includes at least one operational mode having reduced power consumption, and may further include a high-current operational mode. Further, the operational modes of the linear voltage regulator may correspond to predefined operational modes of the associated IC, such as "normal" and "sleep" or other reduced power operational modes. Use of the frequency compensation circuit ensures stable operation of the linear voltage regulator across a large load current range.

FIG. 1 is a schematic block diagram of an integrated circuit having a linear voltage regulator, according to one or more embodiments. The integrated circuit (IC) 100 may have any suitable form, such as a general-purpose microprocessor or special-purpose processor, logic gates, flip-flops, multiplexers, and so forth. Some non-limiting examples of special-purpose processors include digital signal processors (DSPs), graphics processors, and microcontrollers. The integrated circuit (IC) 100 comprises a voltage source 105 generating an input voltage $V_{IN}$. In some embodiments, the input voltage $V_{IN}$ provides a substantially direct current (DC) voltage, but may also include ripple or other small voltage variations. In an alternate embodiment, the voltage source 105 is external to the IC 100. The IC 100 further comprises an input filter configured to filter the input voltage $V_{IN}$, which is depicted as a single capacitor 110, but may include more complex filtering arrangements. In some embodiments, the input filter comprises a low-pass filter such as an RC filter.

The IC 100 further comprises a linear voltage regulator 115 configured to receive the input voltage $V_{IN}$ and to produce an output voltage $V_{OUT}$. In some embodiments, the output voltage $V_{OUT}$ is a substantially DC voltage. An output filter is included to filter the output voltage $V_{OUT}$, which is depicted as a simple capacitor 120, but may include more complex filtering arrangements.

The linear voltage regulator 115 is configured to provide a variable load current $I_L$ to a load element 125 while maintaining a desired output voltage $V_{OUT}$ across the load element 125. The load element 125 may include any suitable passive or active load and generally has a variable resistance (or conductance). The load element 125 may include a central processing unit (CPU) located on the IC 100 and/or any other suitable circuitry coupled with a supply voltage bus (e.g., VDD). The linear voltage regulator 115 comprises a pass element 130 having an adjustable resistance (or conductance) that is controlled to provide a desired voltage drop across the pass element 130. In some embodiments, the linear voltage regulator 115 comprises a LDO regulator. In one embodiment, the pass element 130 comprises a p-type or n-type field-effect transistor (PFET or NFET). In another embodiment, the pass element comprises a NPN or PNP bipolar junction transistor (BJT). In an alternate embodiment, the linear voltage regulator 115 is replaced with a standard linear regulator generally configured to provide a larger voltage drop across the pass element 130 than the linear voltage regulator 115, and the standard linear regulator may use a Darlington NPN or PNP transistor as the pass element 130.

During operation, changes in the load current $I_L$ occur responsive to a change in the resistance (or conductance) of the load element 125. The changes in the load current $I_L$, in turn, influence the output voltage $V_{OUT}$. A feedback loop within the linear voltage regulator 115 adjusts the operation of the pass element 130 to mitigate the influences of the changes in the load current $I_L$ on the output voltage $V_{OUT}$. To ensure the desired output voltage $V_{OUT}$ is maintained, the difference between the output voltage $V_{OUT}$ and the input voltage $V_{IN}$ is at least a dropout voltage associated with the pass element 130. Embodiments of the disclosure are generally suitable for any dropout voltages.

The linear voltage regulator 115 further comprises an error amplifier 140 having a relatively large output impedance. Some non-limiting examples of the error amplifier 140 include a folded cascode error amplifier, a telescopic error amplifier, or alternately any suitable two-stage error amplifier. A voltage signal based on the output voltage $V_{OUT}$ is provided to the error amplifier 140. Although not depicted, in some embodiments, the output voltage $V_{OUT}$ is provided across a voltage divider, and a voltage signal at a center tap of the voltage divider is received at one input terminal of the error amplifier 140. A reference voltage $V_{REF}$ representing a bandgap reference voltage is applied to another input terminal of the error amplifier 140. Based on the comparison of the voltages applied to the input terminals, the error amplifier 140 generates a control signal 150 at an output node 145. The output node 145 is coupled with a control node 135 of the pass element 130. In some embodiments, the control node 135 represents a gate terminal or base terminal of the pass element 130, and the control signal 150 operates to change a conductance of the pass element 130.

Figure 2:
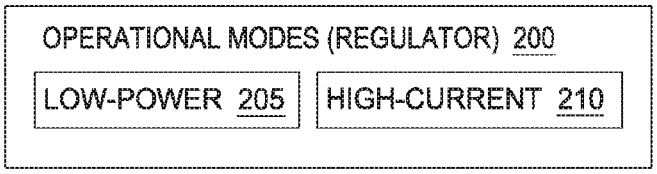
FIG. 2 illustrates a plurality of predefined operational modes of a linear voltage regulator, according to one or more embodiments.

The linear voltage regulator 115 further includes a frequency compensation circuit 155 that is coupled with the output node 145 of the error amplifier 140 and with the control node 135 of the pass element 130. The frequency compensation circuit 155 generally comprises a selectable impedance which is adjusted based on a selected operational mode of the linear voltage regulator 115. In some embodiments, the frequency compensation circuit 155 is coupled between the output node 145 and a supply voltage rail such as a positive supply voltage or ground. Thus, the control signal 150 generated at the output node 145 is influenced by the output impedance of the error amplifier 140 and the impedance presented by the frequency compensation circuit 155. An exemplary plurality of predefined operational modes of the linear voltage regulator 115 are illustrated in FIG. 2 and discussed below. An exemplary frequency compensation circuit 155 is illustrated in FIGS. 3 and 4 and discussed below.

In some embodiments, the IC 100 comprises a memory 160 including a plurality of predetermined operational modes 165 of the IC 100. The memory 160 may include a variety of computer-readable media selected for their size, relative performance, or other capabilities: volatile and/or non-volatile media, removable and/or non-removable media, etc. Additionally or alternately, the predetermined operational modes 165 may be implemented with hardware-based logic (such as gates or switches) of the IC 100. As shown, the operational modes 165 include a "normal" operational mode 175 and a "sleep" operational mode 170. Generally, the sleep mode 170 is intended to represent a mode in which the IC 100 has a lesser power consumption than in the normal operational mode 175. The normal operational mode 175 generally represents a full (or rated) power consumption of the IC 100. In alternate embodiments, the plurality of operational modes 165 comprises a plurality of modes having lesser power consumption levels than the normal operational mode 175.

The predetermined operational modes 165 of the IC 100 may be used to select an operational mode of the linear voltage regulator 115. For example, the IC 100 may provide one or more control signals 180 to the linear voltage regulator 115 based on the selected operational mode 165, and the linear voltage regulator 115 selects its operational mode based on the control signals 180. FIG. 2 illustrates a plurality of predefined operational modes 200 of the linear voltage regulator 115, according to one or more embodiments. As shown, the operational modes 200 include a low-power operational mode 205 and a high-current operational mode 210 of the linear voltage regulator 115. However, one or more additional or alternate operational modes may be included within the plurality of predefined operational modes 200. In one embodiment, operating the IC 100 in its sleep mode 170 controls the linear voltage regulator 115 to be operated within the low-power operational mode 205. Similarly, operating the IC 100 in the normal mode 175 controls operation of the linear voltage regulator 115 within the high-current operational mode 210.

Figure 3:
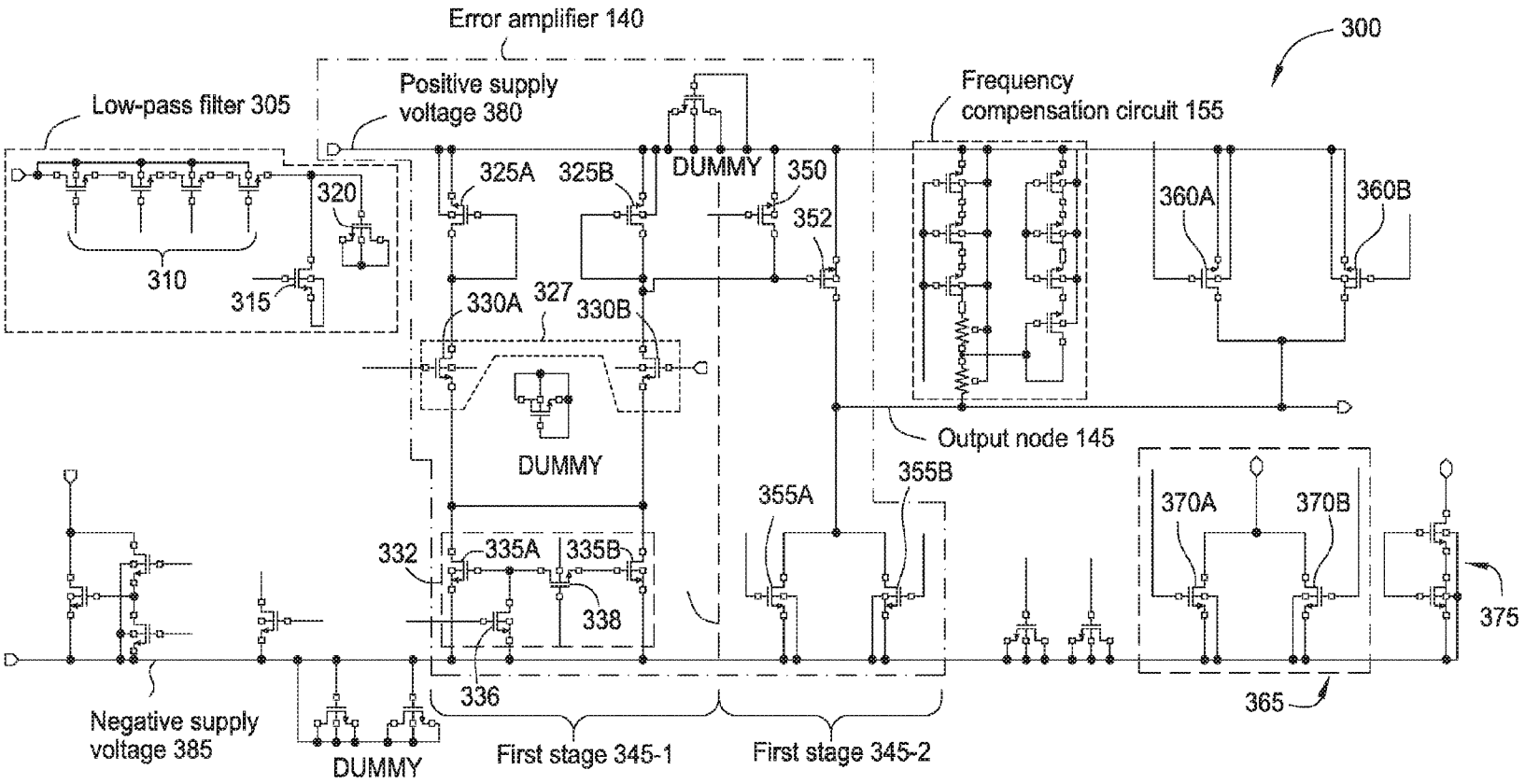
FIG. 3 is a circuit diagram illustrating an exemplary arrangement including an error amplifier coupled with a frequency compensation circuit, according to one or more embodiments.
Figure 4:
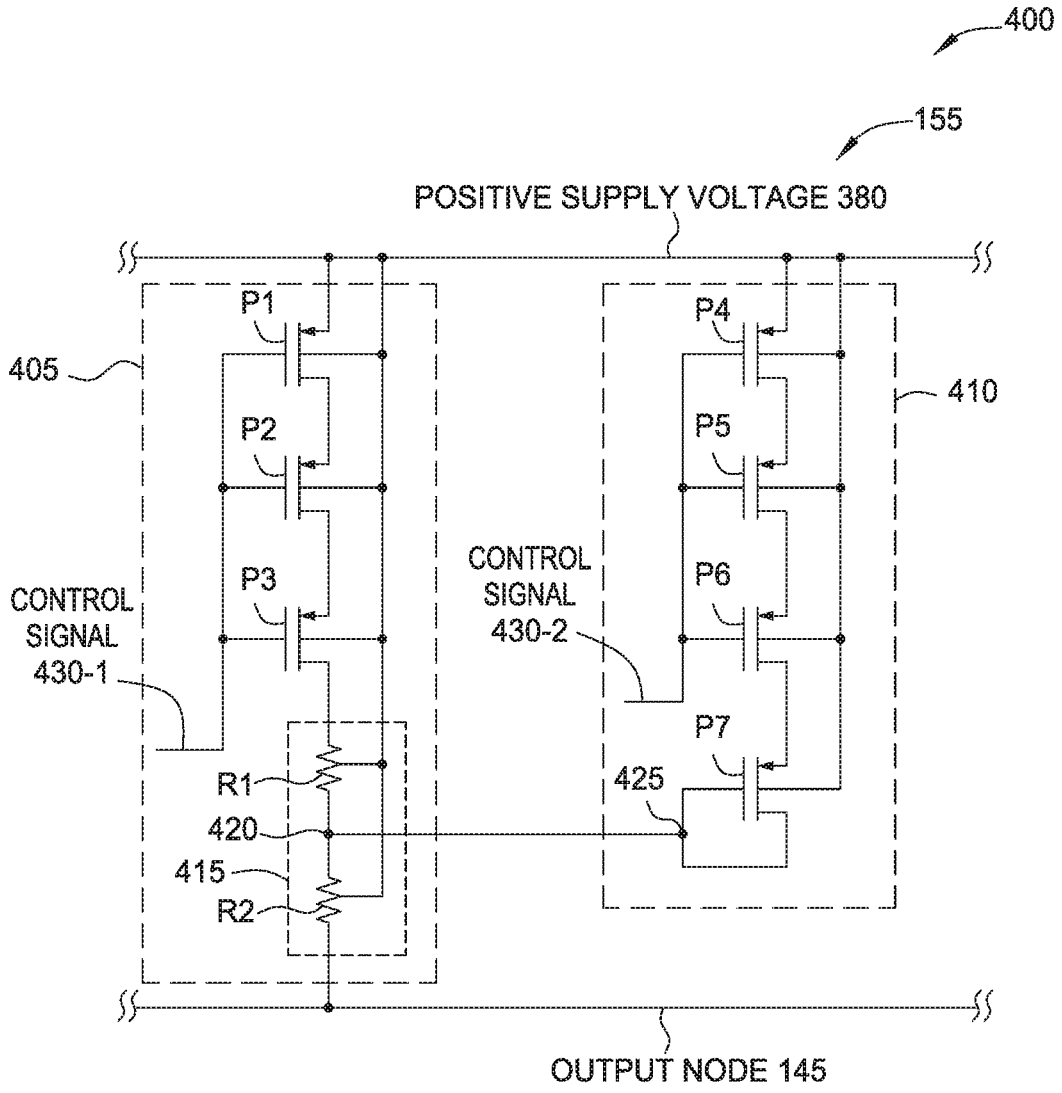
FIG. 4 is a circuit diagram illustrating an exemplary frequency compensation circuit, according to one or more embodiments.

FIG. 3 is a circuit diagram illustrating an exemplary arrangement including an error amplifier coupled with a frequency compensation circuit, according to one or more embodiments. More specifically, arrangement 300 includes various portions of the IC 100 depicted in FIG. 1. Although other portions of the IC 100 are not explicitly depicted within arrangement 300 (e.g., such as the pass element 130), the person of ordinary skill will understand suitable configurations of these portions, as well as suitable arrangement relative to the portions of IC 100 that are depicted within arrangement 300.

Within the arrangement 300, a low-pass filter (LPF) 305 is coupled with the error amplifier 140. An output node 145 of the error amplifier 140 is coupled with the frequency compensation circuit 155. The LPF 305 comprises a plurality of series-connected transistors 310 coupled with a pull-down transistor 315 and a capacitor 320. The LPF 305 is generally configured to pass a bandgap voltage providing a constant voltage despite variations in power supply, temperature, and circuit loading. The LPF 305 may have any alternate suitable arrangement for passing a bandgap voltage, such as a different number of series-connected transistors 310.

The error amplifier 140 comprises two amplifier stages: a first stage 345-1 having a differential input amplifier, and a second stage 345-2 having a common source amplifier. The first stage 345-1 and the second stage 345-2 are shown as being divided along line 340. The error amplifier 140 is coupled with a positive supply voltage 380 and a negative supply voltage 385, although any suitable alternate supply voltage regimes may be provided (e.g., a positive voltage relative to a ground). The first stage 345-1 comprises two diode-connected PFETs 325A, 325B that are coupled between the positive supply voltage 380 and a differential pair 327 comprising NFETs 330A, 330B. The differential pair 327 is configured to receive a differential voltage signal at the NFETs 330A, 330B, with a voltage signal based on the output voltage $V_{OUT}$ received NFET 330B, and the bandgap reference voltage $V_{REF}$ received at NFET 330A. The NFETs 330A, 330B are further coupled with tail current sources 332 comprising NFETs 335A, 335B configured to draw a desired amount of current through the NFETs 330A, 330B. NFETs 336, 338 are provided to allow NFET 335A to be turned off in a low-power mode of the liner voltage regulator 115.

A source terminal of the PFET 330B is further coupled with the second stage 345-2. The second stage 345-2 comprises PFETs 350, 352, and a drain terminal of PFET 350 and a gate terminal of PFET 352 are coupled with the source terminal of PFET 330B. A drain terminal of PFET 352 is coupled with output node 145. A control signal generated on the output node 145 (e.g., control signal 150 of FIG. 1) may be subsequently used to control operation of a pass element of the linear voltage regulator. The second stage 345-2 further comprises two current sources NFETs 355A, 355B which are operated to draw selected amount(s) of current through the PFET 352.

Generally, the power consumption of the arrangement 300 is controlled based on the selected operational mode of the associated linear voltage regulator and/or associated IC. In one non-limiting example, in a normal operational mode of the IC and/or a high-current operational mode of the linear voltage regulator, the NFET 335A of the first stage 345-1 sources 3 microamps (uA) and NFET 335B sources 1 uA. Within the second stage 345-2, the NFET 355A sources 6 uA and NFET 355B sources 2 uA. Thus, within the IC normal operational mode and/or the linear voltage regulator high-current operational mode, the error amplifier 140 consumes about 12 uA (e.g., 4 uA by the first stage 345-1 and 8 uA by the second stage 345-2).

In a sleep operational mode of the IC and/or a low-power operational mode of the linear voltage regulator, NFETs 336, 338 are operated such that the NFET 335A is shut off and sources substantially no current while the NFET 335B sources 1 uA. Within the second stage 345-2, the NFET 355A is shut off and sources substantially no current while the NFET 355B sources 2 uA. Thus, within the IC sleep mode and/or the linear voltage regulator low-power operational mode, the error amplifier 140 consumes approximately 3 uA (e.g., about 25% of the normal operational mode current consumption).

Although certain source current values are included in the example provided above, the person of ordinary skill will understand that the arrangement 300 may be configured to provide different source current values. The source current values may be based on a desired range of load current values to be produced at the output node 145. For example, one or more of the NFETs 335A, 335B, 355A, 355B may be dimensioned differently to source different amounts of current.

Arrangement 300 comprises a static current module 365 including NFETs 370A, 370B that are configured to draw a static current through the pass element. Generally, when no load current is drawn through the connected pass element, the amount of current traversing the feedback loop can drop to as little as a few uA. To ensure that the feedback loop functions consistently, the static current module 365 draws a predetermined amount of static current when the load current (i.e., through the pass element) is less than a predetermined threshold current value. In one embodiment, the NFET 370A sources 1 uA and NFET 370B sources 9 uA in the normal operational mode of the IC and/or a high-current operational mode of the linear voltage regulator (e.g., a total current consumption of 10 uA). In the sleep operational mode of the IC and/or the low-power operational mode of the linear voltage regulator, the NFET 370B is shut off and sources substantially no current while the NFET 370A sources 1 uA (e.g., about 10% of the normal operational mode current consumption). The arrangement 300 further comprises overcurrent protection circuitry 375 comprising two NFETs, although other configurations are possible.

In addition to different components of the error amplifier 140, other portions of the arrangement 300 may also be controlled based on the selected operational mode of the associated linear voltage regulator and/or associated IC. For example, the predetermined amount of static current drawn by the static current module 365 may be further based on the selected operational mode of the associated linear voltage regulator and/or associated IC. In one non-limiting example, in a normal operational mode of the IC and/or a high-current operational mode of the linear voltage regulator, the NFET 370A sources 1 uA and NFET 370B sources 9 uA. Thus, the static current module 365 collectively consumes about 10 uA. Within a sleep operational mode of the IC and/or a low-power operational mode of the linear voltage regulator, the NFET 370B is shut off and sources substantially no current while the NFET 370A sources 1 uA. Thus, within the IC sleep mode and/or the linear voltage regulator low-power operational mode, the static current module 365 consumes approximately 1 uA (e.g., about 10% of the normal operational mode current consumption).

As discussed above, the output node 145 is coupled with a pass element (e.g., pass element 130 of FIG. 1) and configured to provide a load current to an associated load element (e.g., load element 125 of FIG. 1). The output node 145 is further connected with power-down PFETs 360A, 360B configured to shut off power to elements of the arrangement 300 in a sleep operational mode of the IC and/or a low-power operational mode of the linear voltage regulator.

In one embodiment, the linear voltage regulator associated with the arrangement 300 is configured to provide an output voltage of about 1.2 volts (V) from an input voltage of about 3.3 V, although other suitable values are also possible. In one embodiment, the arrangement 300 is configured to provide a range of load current values between about 10 uA (during a low-power or sleep operational mode) and about 20 milliamps (mA) (during a high-current or normal operational mode) to the load element. While a ratio of the load current values in such an embodiment is about 2,000 (e.g., 20 mA to 10 uA), the arrangement 300 is configured to support different ratio(s) of load current values within the different operational modes. In some embodiments, the arrangement 300 supports a range of load current values with a ratio of about five hundred times (500×) or greater.

FIG. 4 is a circuit diagram illustrating an exemplary frequency compensation circuit, according to one or more embodiments. Arrangement 400 represents one possible implementation of the frequency compensation circuit 155 used within a linear voltage regulator 115 and illustrated in FIGS. 1 and 3.

The arrangement 400 includes two impedance branches 405, 410 arranged in parallel and arranged between the positive supply voltage 380 and the output node 145. Impedance branch 405 comprises a series connection of one or more PFETs P1, P2, P3 operating in linear mode and a polysilicon resistor R1. While three PFETs P1, P2, P3 are illustrated, alternate embodiments may include different numbers of PFETs within the series connection. Further, alternate embodiments may replace one or more of the PFETs P1, P2, P3 with a polysilicon resistor. When impedance branch 405 is activated (or "turned on"), a common control signal 430-1 operates the PFETs P1, P2, P3 in linear mode. In some embodiments, the polysilicon resistor R1 is included with another polysilicon resistor R2 as a voltage divider 415.

The impedance branch 410 comprises a series connection of one or more PFETs P4, P5, P6 operating in linear mode and a diode-connected PFET P7. While three PFETs P4, P5, P6 are illustrated, alternate embodiments may include different numbers of PFETs within the series connection. Further, alternate embodiments may include a separate polysilicon resistor or replace one or more of the PFETs P4, P5, P6 with a polysilicon resistor. When impedance branch 410 is activated (or "turned on"), a common control signal 430-2 operates the PFETs P4, P5, P6 in linear mode. In one embodiment, and as depicted, the control node 425 of the diode-connected PFET P7 is coupled with a center tap 420 of the voltage divider 415.

The operation of arrangement 400 (e.g., using the control signals 430-1, 430-2) generally enables the linear voltage regulator to provide a stable output voltage across the load element across a relatively large range of load current values (e.g., a ratio of 500× or more), across a range of supply voltages, across a range of temperatures, and so forth. In various embodiments discussed herein, a frequency response of the error amplifier is defined by a dominant pole at an output node of the pass element (e.g., a drain terminal of a PFET or emitter terminal of a BJT), and a non-dominant pole at an output node of the error amplifier. To increase stability of the linear voltage regulator across the large range of load current values, an external capacitance of a few microfarads (uF; e.g., 2 to 3 uF) may be coupled with the output node 145. In some embodiments, the external capacitance is disposed outside the IC that includes the linear voltage regulator. The external capacitance provides a non-dominant pole further defining the frequency response of the error amplifier. Despite the presence of the external capacitance, the large range of load current values still challenges the stability of the error amplifier.

Figure 6:
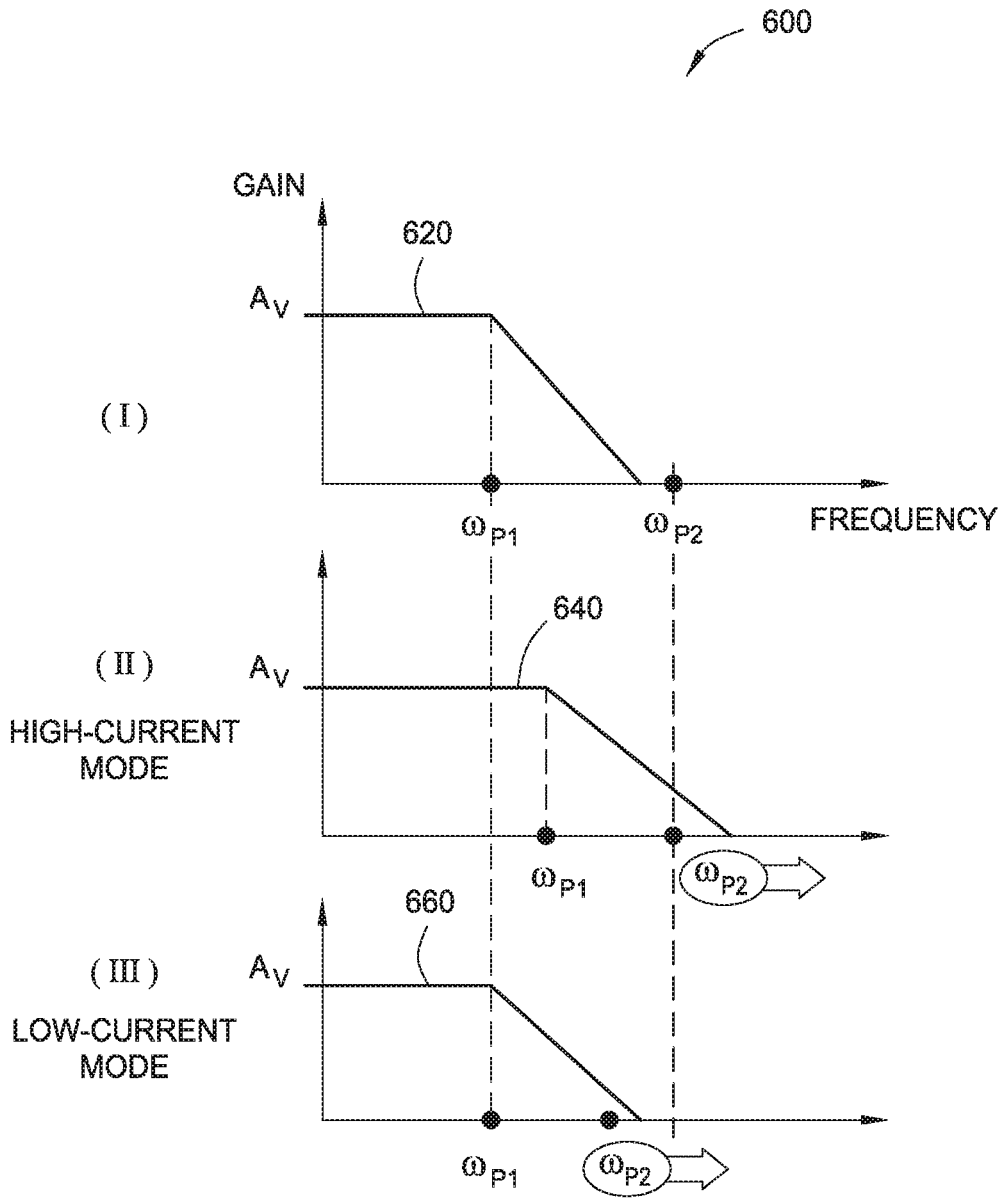
FIG. 6 is a Bode plot for the error amplifier with an exemplary frequency compensation circuit, according to one or more embodiments.

Now referring to FIG. 6, chart 600 illustrates a frequency response for the error amplifier coupled with an exemplary frequency compensation circuit. Plot 620 illustrates a first case (I) representing operation of the error amplifier for "normal" load current values (i.e., away from the extremes of the load current range, which define the associated ratio). The voltage gain $A_V$ of the amplifier is plotted against frequency values. Pole P1 (depicted as frequency $\omega_{P1}$) represents a dominant pole at output of pass element (e.g., a drain terminal). Pole P2 (depicted as frequency $\omega_{P2}$) represents a non-dominant pole at the error amplifier output, which may be defined by an external capacitance coupled with the output. Ideally, frequencies $\omega_{P1}$ and $\omega_{P2}$ are as far apart as possible to ensure stability of the error amplifier control loop. Thus, a reduced distance between frequencies $\omega_{P1}$ and $\omega_{P2}$ generally corresponds to a reduced stability of the error amplifier control loop.

Plot 640 illustrates a second case (II) representing operation of the error amplifier near a maximum load current value of the load current range. In some embodiments, the second case occurs when operating within a high-current operational mode of the associated linear voltage regulator and/or a normal operational mode of the associated IC. Some non-limiting examples of load current values near the maximum load current value are between about 1 mA and 20 mA, which may vary with process corners as well as the activity of the load (e.g., CPU and memory usage).

With increased amounts of current output from the error amplifier, the impedance (or conductance) of the pass element changes causing the frequency $\omega_{P1}$ of the dominant pole P1 to shift toward a higher frequency, and therefore closer to the frequency $\omega_{P2}$ of the non-dominant pole P2. As discussed above, such a reduced distance between frequencies $\omega_{P1}$ and $\omega_{P2}$ corresponds to reduced stability of the error amplifier control loop.

Referring to both FIGS. 4 and 6, for an implementation using a PMOS pass element, the gate voltage of the pass element generally decreases to increase the load current through the pass element. To provide such a reduced gate voltage, a voltage at the output node 145 of the error amplifier is decreased, which also reduces the voltage at the center tap 420 of voltage divider 415. The reduced voltage at the center tap 420 causes the diode-connected PFET P7 to "turn on" and thereby activate the impedance branch 410 disposed between the positive supply voltage 380 and the center tap 420.

The impedance presented by the series connection of PFETs P4, P5, P6 through the diode-connected PFET P7 and polysilicon resistor R2 to the output node 145 is disposed in parallel with the output impedance of the error amplifier, and operates to reduce the effective impedance seen at the output node 145. The reduction in effective impedance causes the frequency $\omega_{P2}$ of the non-dominant pole P2 to shift toward higher frequencies and away from the frequency $\omega_{P1}$. Thus, activating impedance branch 410 causes the frequency $\omega_{P2}$ to increase responsive to an increase in the frequency $\omega_{P1}$, which tends to maintain the phase margin and thereby maintain the stability of the error amplifier near the maximum load current value of the load current range.

Plot 660 illustrates a third case (III) representing operation of the error amplifier near a minimum load current value of the load current range. In some embodiments, the third case occurs when operating within a low-power operational mode of the associated linear voltage regulator and/or a sleep mode of the associated IC. The minimum load current value through the error amplifier may be selected such that a least possible amount of current is wasted. Some non-limiting examples of load current values near the minimum load current value are between about 12 uA and 3 uA.

The reduced current through the error amplifier generally results in an increased output impedance of the error amplifier. As a result, the frequency $\omega_{P2}$ of the non-dominant pole P2 reduces and shifts towards the frequency $\omega_{P1}$ of the dominant pole P1. As discussed above, such a reduced distance between frequencies $\omega_{P1}$ and $\omega_{P2}$ corresponds to reduced stability of the error amplifier control loop.

In some embodiments, the impedance branch 405 is activated to provide an impedance clamp coupled with the output node 145 of the error amplifier. The impedance presented by the series connection of PFETs P1, P2, P3 (operating in linear mode) and polysilicon resistors R1, R2 operates to reduce the effective impedance seen at the output node 145. In some embodiments, the error amplifier has an output impedance between about 10 and 20 megaohms (MΩ), although the output impedance could be even greater due to process variations. In some cases, the output impedance of the error amplifier may oscillate. In some embodiments, the activated impedance branch 405 operates to reduce the effective impedance seen at the output node 145 to between about 1 and 2 MΩ.

The two impedance branches 405, 410 are depicted as connected at the center tap 420. While each impedance branch 405, 410 has been described in terms of its individual functionality, in some cases both impedance branches 405, 410 contribute a respective impedance to provide a desired effective impedance at the output node 145. For example, for the second case (II) representing operation of the error amplifier near a maximum load current value, both impedance branches 405, 410 may provide respective impedances to provide the desired effective impedance at the output node 145. However, both impedance branches 405, 410 need not provide respective impedances for all cases. Continuing the example, in the third case (III) the diode-connected PFET P7 is shut off and effectively isolates the entire impedance branch 410 from the output node 415.

However, in alternate embodiments, the impedance branches 405, 410 may be separate from each other (e.g., disposed in parallel between the positive supply voltage 380 and the output node 145). Other alternate embodiments of the frequency compensation circuit 155 within the linear voltage regulator 115 may include a single one of the impedance branches 405 or 410. For example, the linear voltage regulator may include impedance branch 405 to control output impedance near a minimum load current value of the load current range, without including an impedance branch 410.

The frequency compensation circuit 155 generally provides an improved frequency compensation for the linear voltage regulator, when compared with conventional frequency compensation techniques. For example, the frequency compensation circuit 155 allows for reduced power consumption when compared with adaptive biasing of the error amplifier, which generally modifies the biasing current based on a load current profile. Using the frequency compensation circuit 155 to control the effective impedance at the output of the error amplifier provides a minimal impact design in terms of area and power consumption. Further, analysis using the frequency compensation circuit 155 is relatively simple when compared with multiple-loop frequency compensation techniques. Still further, the various implementations of the frequency compensation circuit 155 may be applied to other control loop architectures having error amplifiers with similar benefits.

Figure 5:
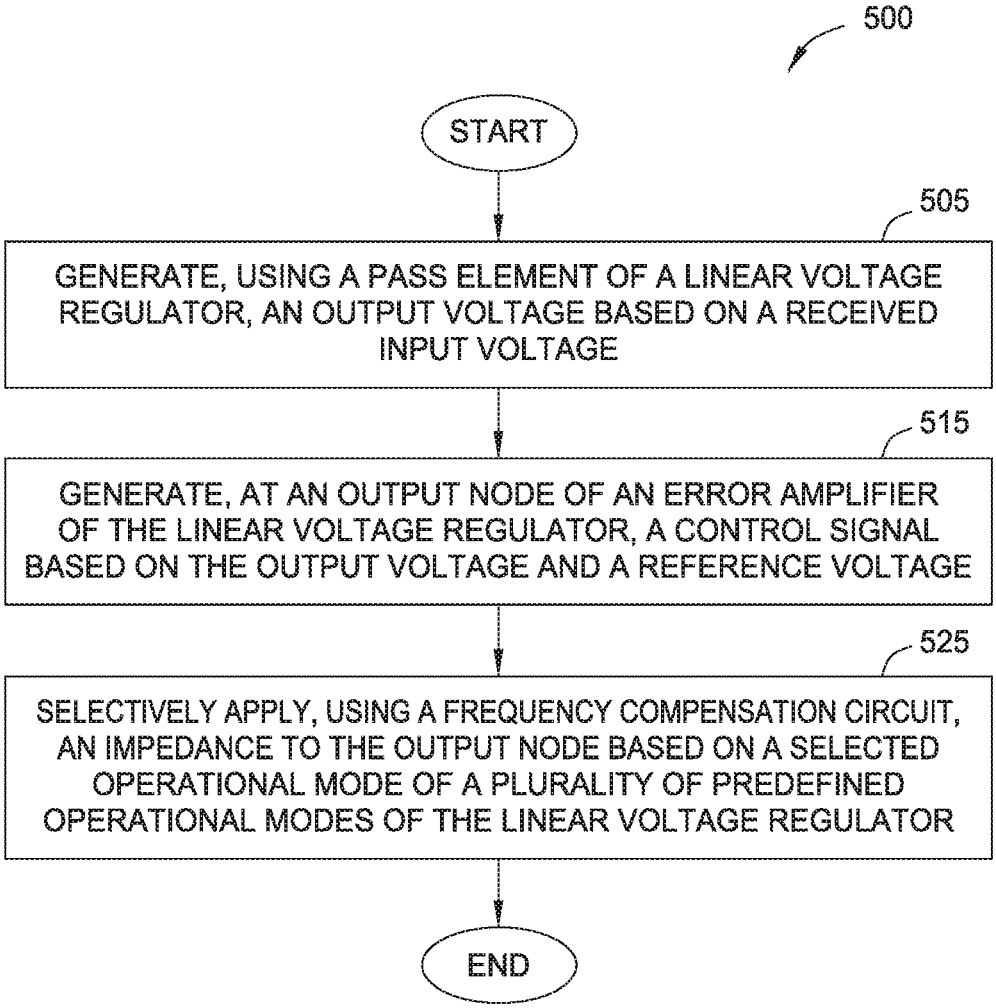
FIG. 5 illustrates a method of operating a linear voltage regulator operable within a plurality of predefined operational modes, according to one or more embodiments.

FIG. 5 illustrates a method of operating a linear voltage regulator operable within a plurality of predefined operational modes, according to one or more embodiments. Method 500 may generally be used in conjunction with any of the embodiments discussed above.

Method 500 begins at block 505, where a pass element of a linear voltage regulator generates an output voltage based on a received input voltage. At block 515, an error amplifier of the linear voltage regulator generates, at an output node, a control signal based on the output voltage and a reference voltage. At block 525, a frequency compensation circuit selectively applies an impedance to the output node based on a selected operational mode of a plurality of predefined operational modes of the linear voltage regulator. In some embodiments, the frequency compensation circuit comprises a plurality of impedance branches, and one or both impedance branches are applied to the output node based on the selected operational mode. Method 500 ends following completion of block 525.

Thus, the embodiments and examples set forth herein were presented in order to best explain the embodiments in accordance with the present technology and its particular application and to thereby enable those skilled in the art to make and use the disclosure. However, those skilled in the art will recognize that the foregoing description and examples have been presented for the purposes of illustration and example only. The description as set forth is not intended to be exhaustive or to limit the disclosure to the precise form disclosed.

In view of the foregoing, the scope of the present disclosure is determined by the claims that follow.

What is claimed is:

1. A linear voltage regulator operable within a plurality of predefined operational modes, the linear voltage regulator comprising:

a pass element configured to generate an output voltage based on a received input voltage;

an error amplifier comprising an output node coupled with a control node of the pass element, the error amplifier configured to generate a control signal at the output node based on the output voltage and a reference voltage; and a frequency compensation circuit comprising a plurality of impedance branches arranged between the output node and a positive supply voltage, wherein the frequency compensation circuit is configured to activate, for each of at least two modes of the plurality of predefined operational modes, a respective one or more impedance branches of the plurality of impedance branches to the output node based on which of the at least two modes is selected.

2. The linear voltage regulator of claim 1, wherein the predefined operational modes comprise a low-power mode, wherein the frequency compensation circuit comprises a series connection of (1) a polysilicon resistor and (2) one or more p-channel field-effect transistors (PFETs) operating in linear mode, the series connection arranged between the output node and a positive supply voltage.

3. The linear voltage regulator of claim 2, wherein activating a respective one or more impedance branches of the plurality of impedance branches comprises activating the series connection to thereby mitigate a frequency decrease of a non-dominant pole of the error amplifier.

4. The linear voltage regulator of claim 3, wherein a dominant pole of the error amplifier is defined by an external capacitance across which the output voltage is applied.

5. The linear voltage regulator of claim 1, wherein the predefined operational modes comprise a high-current mode, wherein the frequency compensation circuit comprises a series connection of (1) a diode-connected p-channel field-effect transistor (PFET) and (2) one or more PFETs operating in linear mode or a polysilicon resistor, the series connection arranged between the output node and a positive supply voltage.

6. The linear voltage regulator of claim 5, wherein activating a respective one or more impedance branches of the plurality of impedance branches comprises activating the series connection to thereby increase a frequency of a non-dominant pole of the error amplifier.

7. The linear voltage regulator of claim 1, wherein a first impedance branch of the plurality of impedance branches comprises a first series connection of (1) a first polysilicon resistor and (2) one or more first p-channel field-effect transistors (PFETs) operating in linear mode; and wherein a second impedance branch of the plurality of impedance branches comprises a second series connection of (1) a diode-connected PFET and (2) one or more second PFETs operating in linear mode or a second polysilicon resistor, the first and second series connections arranged in parallel between the output node and a positive supply voltage, wherein, in a first mode of the at least two modes, activating the first impedance branch mitigates a decrease of a non-dominant pole of the error amplifier, and wherein, in a second mode of the at least two modes, activating the second impedance branch increases the non-dominant pole of the error amplifier.

8. The linear voltage regulator of claim 7, wherein the first polysilicon resistor is included in a voltage divider, wherein a control node of the diode-connected PFET is connected with a center tap of the voltage divider.

9. The linear voltage regulator of claim 7, wherein the frequency compensation circuit enables the output voltage to be stable across a predefined load current range, the predefined load current range including a first load current value corresponding to the first mode and a second load current value corresponding to the second mode, wherein a ratio of the second load current value to the first load current value is five hundred times (500×) or greater.

10. The linear voltage regulator of claim 1, wherein the frequency compensation circuit enables a reduced power consumption of the error amplifier, relative to a configuration in which the error amplifier is biased based on a load current profile.

11. An integrated circuit, comprising:

a load element; and a linear voltage regulator circuit configured to provide a load current to the load element, the linear voltage regulator circuit operable within a plurality of predefined operational modes, the linear voltage regulator circuit comprising:

a pass element configured to generate an output voltage across the load element based on a received input voltage;

an error amplifier comprising an output node coupled with a control node of the pass element, the error amplifier configured to generate a control signal at the output node based on the output voltage and a reference voltage; and a frequency compensation circuit comprising a plurality of impedance branches arranged between the output node and a positive supply voltage, wherein the frequency compensation circuit configured to:

activate, for each of at least two modes of the plurality of predefined operational modes, a respective one or more impedance branches of the plurality of impedance branches to the output node based on which of the at least two modes is selected.

12. The integrated circuit of claim 11, wherein the predefined operational modes comprise a low-power mode, wherein the frequency compensation circuit comprises:

a first series connection of (1) a polysilicon resistor and (2) one or more p-channel field-effect transistors (PFETs) operating in linear mode, the first series connection arranged between the output node and a positive supply voltage, wherein in the low-power mode, activating a respective one or more impedance branches of the plurality of impedance branches comprises activating the first series connection to thereby mitigate a decrease of a non-dominant pole of the error amplifier.

13. The integrated circuit of claim 12, further comprising an external capacitance across which the output voltage is applied, wherein a dominant pole of the error amplifier is defined by the external capacitance.

14. The integrated circuit of claim 12, wherein the predefined operational modes further comprise a high-current mode, wherein the frequency compensation circuit further comprises:

a second series connection of (1) a diode-connected p-channel field-effect transistor (PFET) and (2) one or more PFETs operating in linear mode or a polysilicon resistor, the second series connection arranged between the output node and a positive supply voltage, wherein in the high-current mode, activating a respective one or more impedance branches of the plurality of impedance branches comprises activating the second series connection to thereby increase a non-dominant pole of the error amplifier.

15. The integrated circuit of claim 12, wherein the low-power mode is entered responsive to a control signal indicating that the integrated circuit is in a predefined sleep mode.

16. A method of operating a linear voltage regulator comprising a pass element and an error amplifier, the linear voltage regulator operable within a plurality of predefined operational modes, the method comprising:

generating, using the pass element, an output voltage based on a received input voltage;

generating, at an output node of the error amplifier, a control signal based on the output voltage and a reference voltage, the output node coupled with a control node of the pass element; and using a frequency compensation circuit comprising a plurality of impedance branches arranged between the output node and a positive supply voltage, activating, for each of at least two modes of the plurality of predefined operational modes, a respective one or more impedance branches of the plurality of impedance branches to the output node based on which of the at least two modes is selected.

17. The method of claim 16, wherein the predefined operational modes a low-power mode, wherein the frequency compensation circuit comprises:

a first series connection of (1) a polysilicon resistor and (2) one or more p-channel field-effect transistors (PFETs) operating in linear mode, the first series connection arranged between the output node and a positive supply voltage, wherein in the low-power mode, activating a respective one or more impedance branches of the plurality of impedance branches comprises activating the first series connection to thereby mitigate a decrease of a non-dominant pole of the error amplifier.

18. The method of claim 17, wherein a dominant pole of the error amplifier is defined by an external capacitance across which the output voltage is applied.

19. The method of claim 17, wherein the predefined operational modes further comprise a high-current mode, wherein the frequency compensation circuit further comprises:

a second series connection of (1) a diode-connected p-channel field-effect transistor (PFET) and (2) one or more PFETs operating in linear mode or a polysilicon resistor, the second series connection arranged between the output node and a positive supply voltage, wherein in the high-current mode, activating a respective one or more impedance branches of the plurality of impedance branches comprises activating the second series connection to thereby increase a non-dominant pole of the error amplifier.

20. The method of claim 17, wherein the linear voltage regulator is included within an integrated circuit, the method further comprising:

entering the low-power mode responsive to a control signal indicating that the integrated circuit is in a predefined sleep mode.

* * * * *